US007195526B2

(12) United States Patent
Bernloehr et al.

(10) Patent No.: US 7,195,526 B2
(45) Date of Patent: Mar. 27, 2007

(54) TROLLING MOTOR MOUNT

(75) Inventors: Darrel A. Bernloehr, Mankato, MN (US); Dale E. Simonson, Cleveland, MN (US)

(73) Assignee: Johnson Outdoors, Inc., Racine, WI (US)

( * ) Notice: Subject to any disclaimer, the term of this patent is extended or adjusted under 35 U.S.C. 154(b) by 0 days.

(21) Appl. No.: 11/332,884

(22) Filed: Jan. 17, 2006

(65) Prior Publication Data

US 2006/0116031 A1 Jun. 1, 2006

Related U.S. Application Data

(63) Continuation of application No. 10/847,218, filed on May 17, 2004, now Pat. No. 7,004,804.

(51) Int. Cl.
*B63H 5/125* (2006.01)

(52) U.S. Cl. ..... 440/63; 440/61 R; 440/61 F; 248/642

(58) Field of Classification Search ..... 440/61 R, 440/61 F, 62, 63, 53, 61 T; 248/640, 642
See application file for complete search history.

(56) References Cited

U.S. PATENT DOCUMENTS 3,724,790 A * 4/1973 Harris et al. ..... 248/642
4,966,566 A * 10/1990 Baird ..... 440/6
7,004,804 B2 * 2/2006 Bernloehr et al. ..... 440/63

* cited by examiner

*Primary Examiner*—Sherman Basinger
(74) *Attorney, Agent, or Firm*—Kinney & Lange, P.A.

(57) ABSTRACT

A trolling motor for use with a watercraft is disclosed. The trolling motor comprises a head portion, a propulsion unit, a shaft coupling the propulsion unit to the head portion, and a mounting system configured to secure the trolling motor to the watercraft and to pivot the trolling motor between a deployed position and a stowed position. The mount system comprises a base having a first portion adapted to be mounted to the watercraft and a second portion adapted to receive the trolling motor, a pivot member coupled to the base and configured to pivot between the deployed position and the stowed position, and a damper mechanism coupled to the pivot member and configured to impede the movement of the member as the pivot member is being moved between the deployed position and the stowed position.

29 Claims, 6 Drawing Sheets

TROLLING MOTOR MOUNT

This application is a continuation of U.S. patent application Ser. No. 10/847,218, entitled "Trolling Motor Mount", filed May 17, 2004 now U.S. Pat. No. 7,004,804 by Darrel A. Bernloehr.

FIELD

The present invention relates to trolling motors. More particularly, the present invention relates to a mount for mounting a trolling motor to a watercraft, boat or vessel, etc. The present invention further relates to a trolling motor mount that is configured to pivot between a deployed or use position and a stowed or non-use position.

BACKGROUND

Fishing boats and vessels are often equipped with a trolling motor for providing a relatively small amount of thrust to slowly and quietly propel the boat or vessel while the operator is fishing. Most outboard trolling motors are typically powered by a battery and are mounted to either the bow or the stem of the boat or vessel. Bow mounted trolling motors are generally mounted to the deck at the bow of a boat by means of a base plate screwed or otherwise fastened to the bow of the boat and a chassis, also known as a frame or bracket, coupled to the trolling motor and configured to mate with the base plate.

Such trolling motors may be configured to pivot between a deployed or use position and a stowed or non-use position. However, such known mounting arrangements for trolling motors may present inconvenient or disadvantageous features in application or use, such as relative difficulty to use (e.g., effort and vigilance to stow or deploy). Also, such known arrangements may present inconvenient or undesirable operation such as high impact or velocity deployment of the trolling motor if it is dropped onto the water, which may cause a potential for an unpleasant or startling noise, or for damage to the trolling motor or watercraft.

As can be appreciated, trolling motors include several movable parts that may be susceptible to failure if the trolling motor is dropped, bumped or otherwise knocked around. Damage to a trolling motor is commonly inflicted while an operator is attempting to move the trolling motor from a stowed position to a deployed position. Often this movement is rather abrupt since the weight of the trolling motor increases the acceleration of the trolling motor into the water. Such an abrupt movement may cause unnecessary damage or wear to the trolling motor as the trolling motor impacts the water and/or any other object.

Accordingly, it would be advantageous to provide a trolling motor mounting system that has a compact design and can be readily mounted to a boat or vessel. It would also be advantageous to provide a trolling motor mount system with a mechanism for moving the trolling motor between the deployed position and the stowed position that is more convenient to use. If would further be advantageous to provide a trolling motor mount system that is configured to control the velocity that the trolling motor can be raised and/or lowered. It would further be advantageous to provide a trolling motor mount system that is configured to assist in moving the trolling motor between the deployed and use positions. It would further be advantageous to provide a trolling motor system that is configured to be more convenient to clean, keep clean, and maintain. It would be desirable to provide for a trolling motor system having one or more of these or other advantageous features.

SUMMARY

One embodiment of the invention relates to an apparatus for mounting a trolling motor to a watercraft. The apparatus comprises a base having a first portion adapted to be mounted to the watercraft and a second portion adapted to receive the trolling motor, a member coupled to the base and configured to pivot between a first position (e.g., deployed position) and a second position (e.g., stowed position), and a motion control device coupled to the member and configured to impede the movement of the member (and therefore the trolling member) as the member is being moved between the first position and the second position. The apparatus may further comprising a lever coupled to the motion control device and having an end pivotally coupled to the member and another end acting on the base. The lever may include a pair of spaced apart arms having lower portions in contact with the base portion when in the first position, wherein each of the spaced apart arms comprise a roller for a rolling engagement with the base during at least a portion of the movement between the first position and the second position. The apparatus may further comprise a first latch configured to engage the base when in the deployed position, a second latch configured to engage the base when in the stowed position, wherein the first latch is coupled to the second latch by a connector so that actuation of the first latch causes actuation of the second latch. The first latch and/or second latch may include a pin movable to engage a slot in the base (e.g., movable between a first position and a second position, wherein the pin engages a slot in the base when the pivot member is in the deployed position and the pin is in the first position). The apparatus may comprise a flexible member (e.g., rope or cord, cable, etc.) having one end coupled to the first latch and another end accessible to a person in the watercraft. The motion control device may be configured to provide a first force that biases the member in at least one of the deployed position or the stowed position. For example, the first force may be configured to assist the movement of the member and to counteract a second force generated by the weight of the trolling motor. The motion control device may be configured to provide the first force during only a portion of the pivotal movement of the member (e.g., between the deployed position and about forty-five degrees or fifty degrees from the deployed position).

Another embodiment of the invention relates to a trolling motor for use with a watercraft. The trolling motor comprises a head portion, a propulsion unit, a shaft coupling the propulsion unit to the head portion, and a mounting system configured to secure the trolling motor to the watercraft and to pivot the trolling motor between a deployed position and a stowed position. The mount system comprises a base having a first portion adapted to be mounted to the watercraft and a second portion adapted to receive the trolling motor, a pivot member coupled to the base and configured to pivot between the deployed position and the stowed position, and a damper mechanism coupled to the pivot member and configured to impede the movement of the member as the pivot member is being moved between the deployed position and the stowed position.

Yet another embodiment of the invention relates to a trolling motor for use with a watercraft. The trolling motor comprises a head portion a propulsion unit, a shaft coupling the propulsion unit to the head portion, a pivot member coupled to the shaft and to the watercraft, and configured to pivot between a deployed position and a stowed position, and means for impeding movement of the pivot member between the deployed position and the stowed position.

The present invention further relates to various features and combinations of features shown and described in the disclosed embodiments.

DETAILED DESCRIPTION OF THE PREFERRED AND EXEMPLARY EMBODIMENTS

Figure 1:
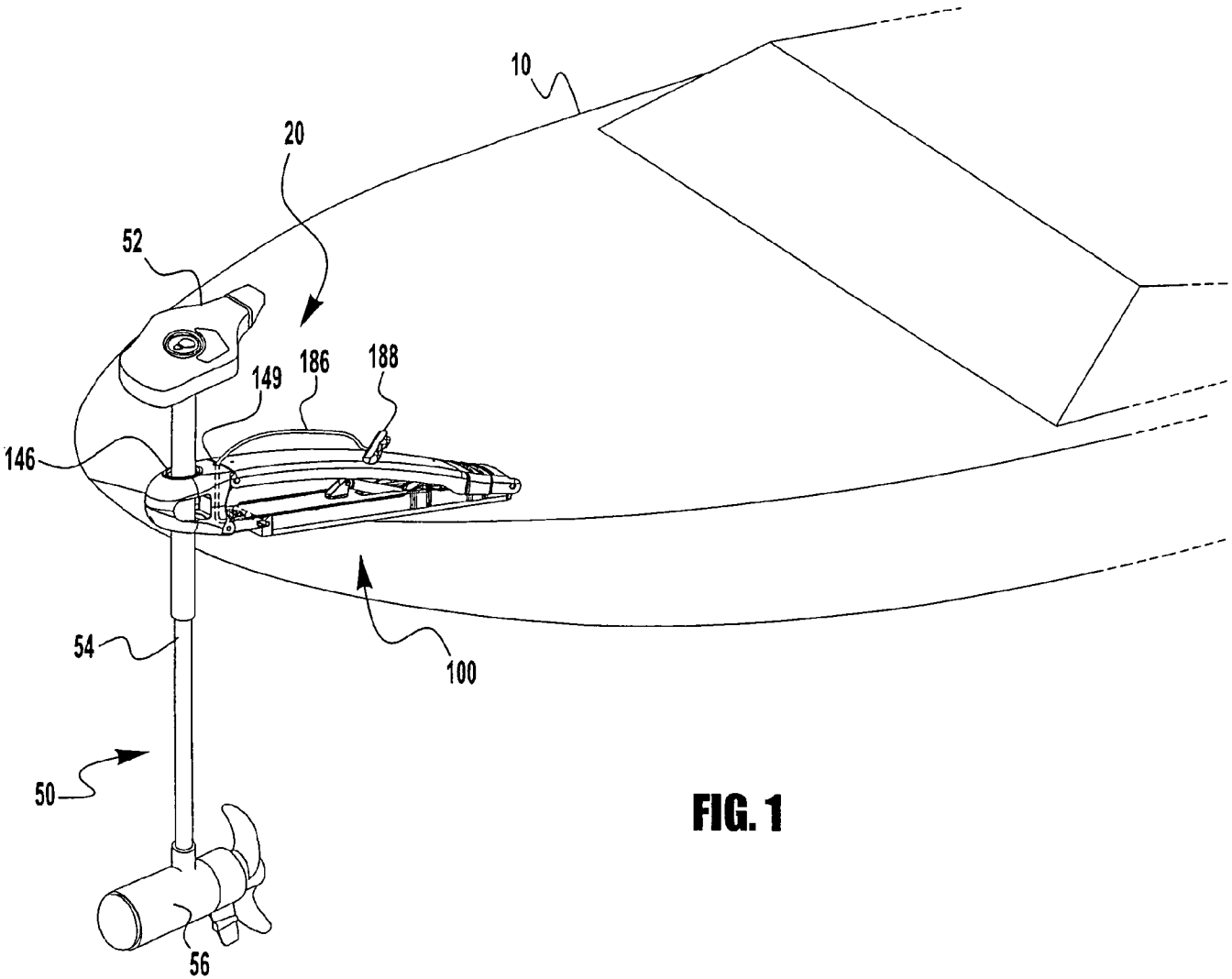
FIG. 1 is a perspective view of a trolling motor mount system shown in a deployed position mounted to a watercraft and supporting a trolling motor according to an exemplary embodiment.

Referring to FIG. 1, an exemplary embodiment of a trolling motor system 20 employed on a watercraft 10 is shown. Watercraft 10 is a conventionally known boat or vessel which generally extends along a longitudinal axis from a front bow to a rear or stern terminating at a transom. As shown, the front bow may include a generally flat mounting surface or deck upon which trolling motor system 20 is supported. As will be appreciated, watercraft 10 may have a variety of alternative sizes, shapes and configurations.

Trolling motor system 20 generally includes a mount system 100 and a trolling motor 50. Trolling motor 50 generally includes an operating head 52, a shaft 54, and a propulsion unit 56 (e.g., a lower unit). Mount system 100 affects the movement of trolling motor 50 between a deployed or "use" position (see FIG. 1) wherein shaft 54 is generally perpendicular to the longitudinal axis of watercraft 10 and a stowed or "non-use" position (see FIG. 2). For example, mount system 100 may be configured to control, assist, guide, resist, bias or the like the movement of trolling motor 50 between the deployed positions and the stowed positions.

According to a preferred embodiment, mount system 100 is configured to control or dampen the movement or velocity of trolling motor 50 as it is being moved between its stowed and deployed positions. Controlling or dampening the movement or velocity of trolling motor 50 is intended to avoid impact, noise, and potential damage to components such as operating head 52, shaft 54, and/or propulsion unit 56, and the like (e.g., if an operator accidentally or prematurely releases trolling motor 50). According to a preferred embodiment, mount system 100 is further configured to assist or bias the movement of trolling motor 50 as it is being moved between its deployed and stowed positions. Biasing or assisting the movement of trolling motor 50 is intended to reduce the force that an operator must exert when moving trolling motor 50 between its deployed and stowed positions.

According to an exemplary embodiment, shown in the FIGURES, mount system 100 generally includes a housing 102 and a pivot mechanism 104. Housing 102 includes a base member shown as a bow plate 110, a cover shown as an upper arm 130, and a front portion motor support shown as bow guard 140. Pivot mechanism 104 is coupled to housing 102 and includes a member shown as lower arm 150, a latch system 170, a motion dampening device 300, and a pivot lever shown as a yoke 320.

Figure 2:
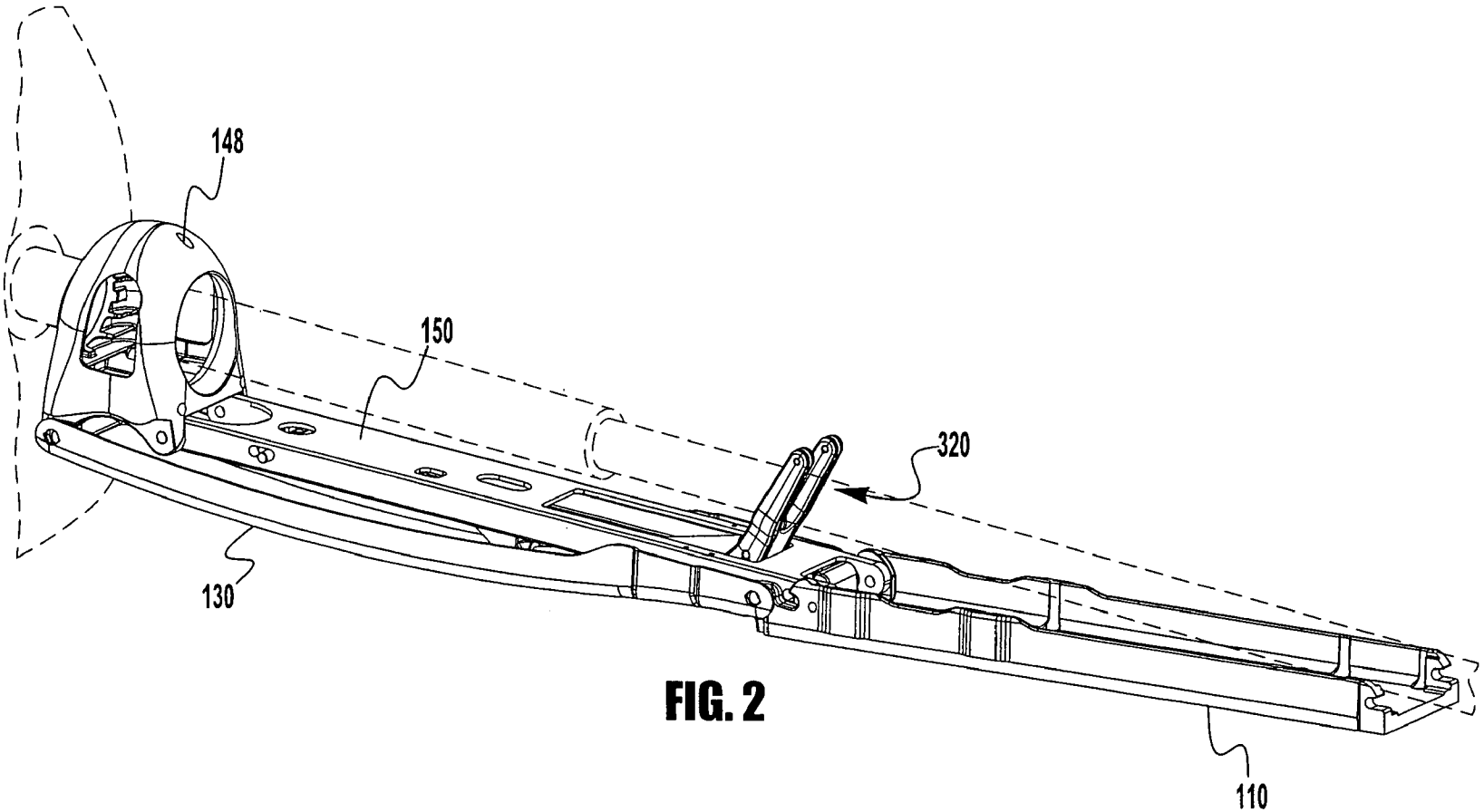
FIG. 2 is a perspective view of a trolling motor mount system shown in a stowed position and supporting a trolling motor according to an exemplary embodiment.

Referring to FIGS. 1 and 2, bow plate 110 is configured to couple mount system 100 (and therefore trolling motor 50) to watercraft 10. As described further below, bow plate 110 is also pivotally coupled to an end of lower arm 150 and an end of upper arm 130 and is releasably coupled to another portion of upper arm 130 and lower arm 150. According to an exemplary embodiment, and as more clearly shown in FIG. 5, bow plate 110 includes a bottom portion 112 that is configured to be mounted watercraft 10. Bottom portion 112 may be a generally rectangular member extending along a longitudinal axis between a first end 114 and a second end 116. Preferably, bottom portion 112 has a substantially flat bottom surface that can be mounted to the bow of watercraft 10. According to a particularly preferred embodiment, bow plate 110 further includes a pair of spaced apart outer walls 118, 120 extending upward from bottom portion 112 and longitudinally between first end 114 and second end 116. Outer walls 118, 120 define a recess shown as a channel 122 for receiving pivot mechanism 104.

According to an exemplary embodiment, bow plate 110 further includes portions corresponding to the latch system 170 of pivot mechanism 104. As will be discussed below, latch system 170 preferably includes a front latch for releasably engaging second end 116 of bow plate 110 and a rear latch for releasably engaging first end 114 of bow plate 110. According to a preferred embodiment, bow plate 110 includes apertures, recesses, cutout portions, slots, or the like in outer walls 118, 120 near ends 114, 116 for receiving a portion of latch system 170. According to a particularly preferred embodiment, a first catch 124 is positioned near second end 116 and is configured to releasably engage a front latch, and a second catch 126 is positioned near first end 114 and is configured to releasably engage a rear latch. Bow plate 110 may further include at least one aperture configured to received a mechanical fastener for mounting trolling motor system 20 to watercraft 10. According to a particularly preferred embodiment, a plurality of countersunk holes 128 configured to receive a screw or bolt are included in bottom portion 112. As such, mounting system 100 is illustrated as a bow mount type. Alternatively, trolling motor system 20 may be mounted to the watercraft by a transom mount type.

Figure 5:
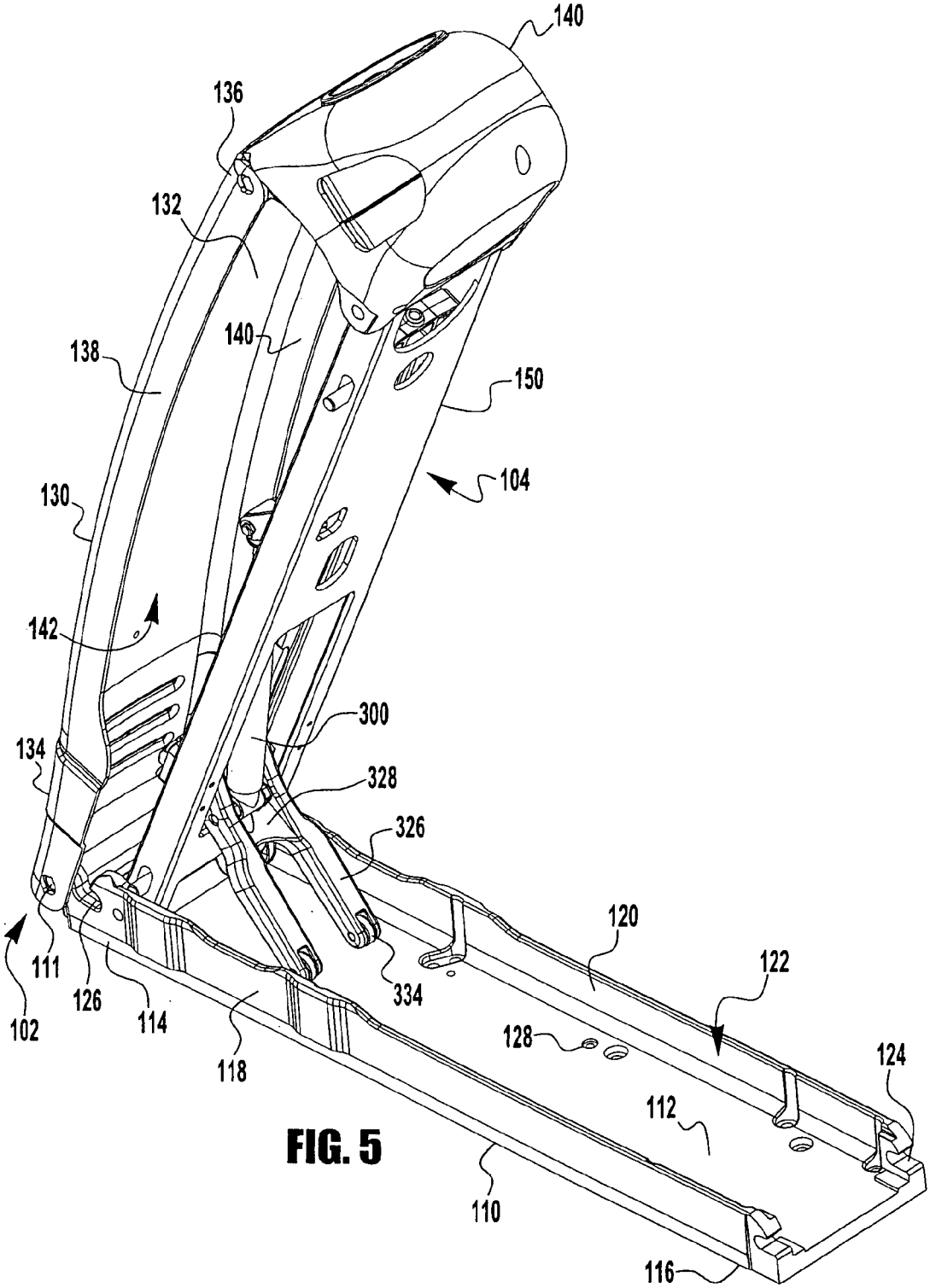
FIG. 5 is a perspective view of a trolling motor mount system shown between a deployed and stowed position according to an exemplary embodiment.

Still referring to FIG. 5, upper arm 130 is pivotally coupled to bow plate 110 at one end and bow guard 140 at a second end. Upper arm 130 is configured to guard or protect pivot mechanism 104. According to an exemplary embodiment, upper arm 130 generally includes top portion shown as a cover 132 extending along a longitudinal axis between a first end 134 and a second end 136. First end 134 is pivotally coupled to first end 114 of bow plate 110 and second end 136 is coupled to bow guard 140. Upper arm 130 may be pivoted to bow plate 110 about a pivot pin 111 and to bow guard 140 about a pivot pin 111. According to a preferred embodiment, upper arm 130 further includes a pair of spaced apart outer walls 138, 140 extending downward from cover 132 and longitudinally between first end 134 and second end 136. Outer walls 138, 140 define a recess shown as a channel 142 for receiving pivot mechanism 104. Upper arm 130 is configured to rotate between deployed position (shown in FIG. 1) and a stowed position (see FIG. 2). In the deployed position, upper arm 130 is substantially parallel with bow plate 110 and together upper arm 130 and bow plate 110 substantially enclose pivot mechanism 104. From the deployed position, upper arm 130 is pivotally moved about pivot pin 111 to reach the stowed position. According to a particularly preferred embodiment, upper arm 130 is rotated approximately 175 degrees when moved between the deployed and stowed positions. Upper arm 130 may be shaped as a generally rectangular member or may have a curvilinear geometry to provide a more streamlined profile for aesthetic purposes.

Figure 4:
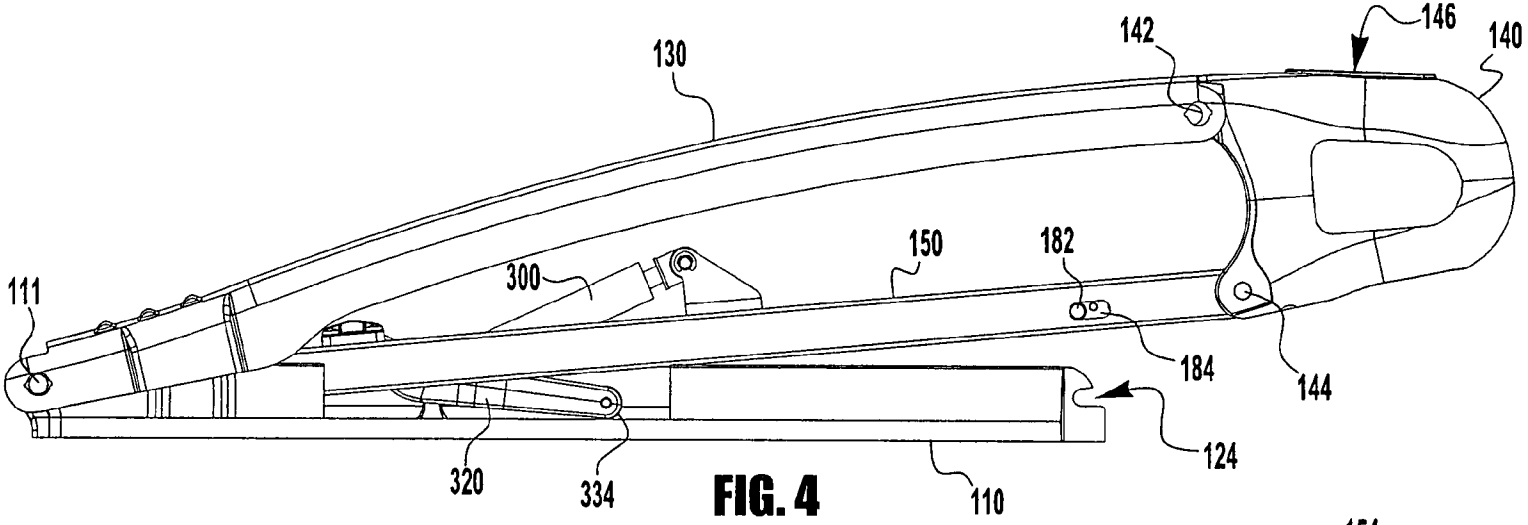
FIG. 4 is a side view of a trolling motor mount system shown between a deployed and stowed position according to an exemplary embodiment.

Referring to FIG. 4, bow guard 140 couples second end 136 of upper arm 130 and lower arm 150 (discussed below) about a pair of pivot points 142, 144 respectively. Bow guard 140 also includes an aperture 146 that is configured to receive shaft 54 of trolling motor 50. An aperture 148 (shown in FIG. 2) may be provided to receive a locking means for securing shaft 54 to bow guard 140. According to a preferred embodiment, a flexible linking member 186 passes through an aperture 149 (shown in FIG. 1) in bow guard 140 and is coupled to latch system 170. An operator uses the flexible linking member to actuate mount system 100. Flexible member 186 may be any of a variety of members such as a rope, cable, cord, and the like.

Figure 3:
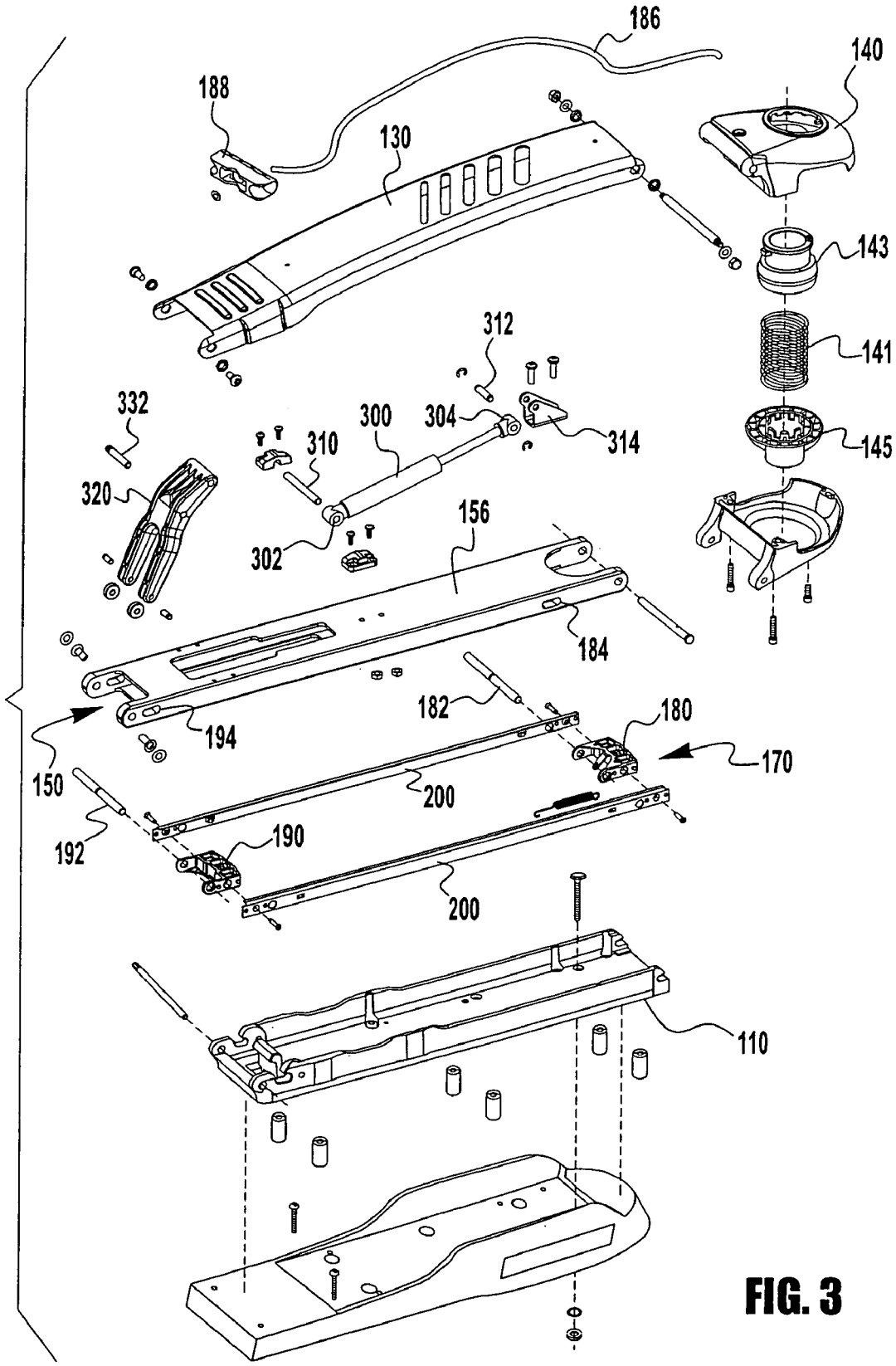
FIG. 3 is a fragmentary view of a trolling motor mount system according to an exemplary embodiment.

According to an exemplary embodiment, bow guard 140 may also include an impact protection system for absorbing some of the shock that trolling motor 50 may incur during use (e.g., from impacting or colliding with an underwater obstruction). Referring to FIG. 3, the impact protection system generally includes a spring 141 that is disposed between a upper sleeve 143 and a lower sleeve 145. Upper sleeve 143, lower sleeve 145, and spring 141 are enclosed by bow guard 140. Shaft 54 is inserted through the impact protection system which is axially aligned with aperture 146. Impact protection systems are known, and accordingly, mount system 100 may include any known or otherwise appropriate system for protecting trolling motor 50 from damage caused by an impact or collision with an underwater obstruction.

Bow plate 110, upper arm 130, and bow guard 140 cooperate to support and/or receive pivot mechanism 104. According to a preferred embodiment, pivot mechanism 104 provides a dual function. First, pivot mechanism controls or dampens the movement or velocity of trolling motor 50 as it is being moved between its stowed and deployed positions. Second, pivot mechanism 104 assists or biases the movement of trolling motor 50 as it is being moved between its deployed and stowed positions. As mentioned above, pivot mechanism 104 includes lower arm 150, latch system 170, motion dampening device 190, and yoke 320.

Figure 7:
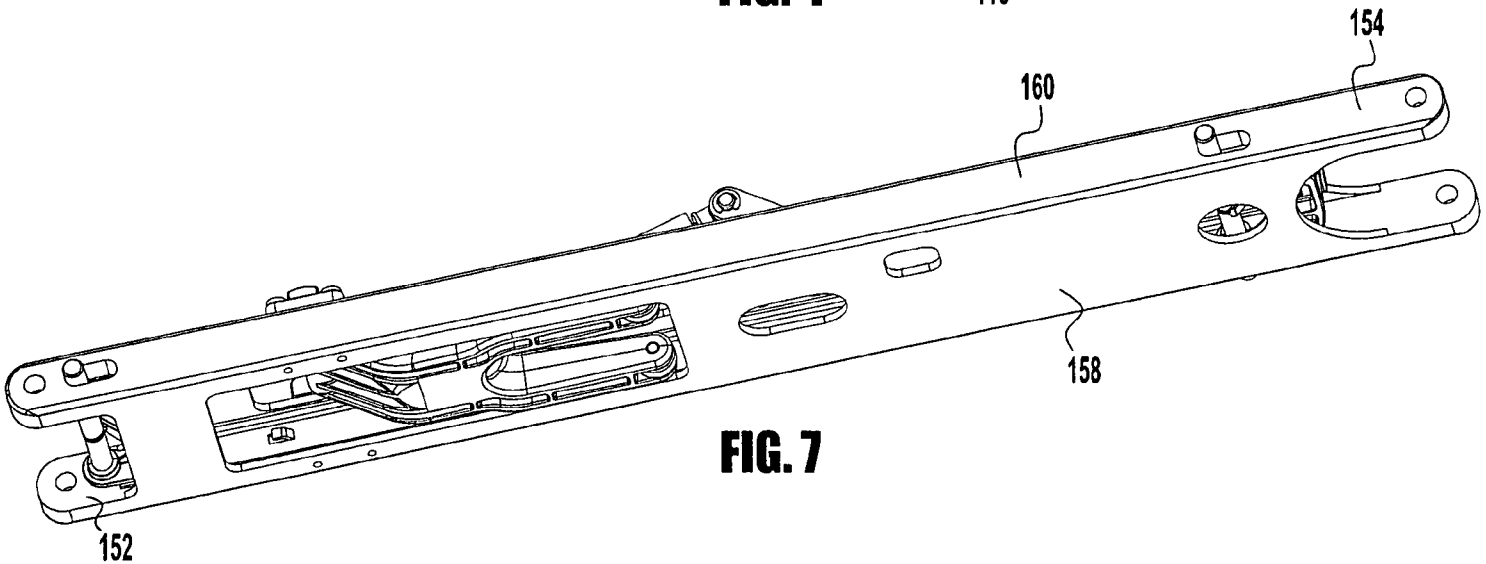
FIG. 7 is a bottom perspective view of a pivot mechanism of a trolling motor mount system according to an exemplary embodiment.
Figure 6:
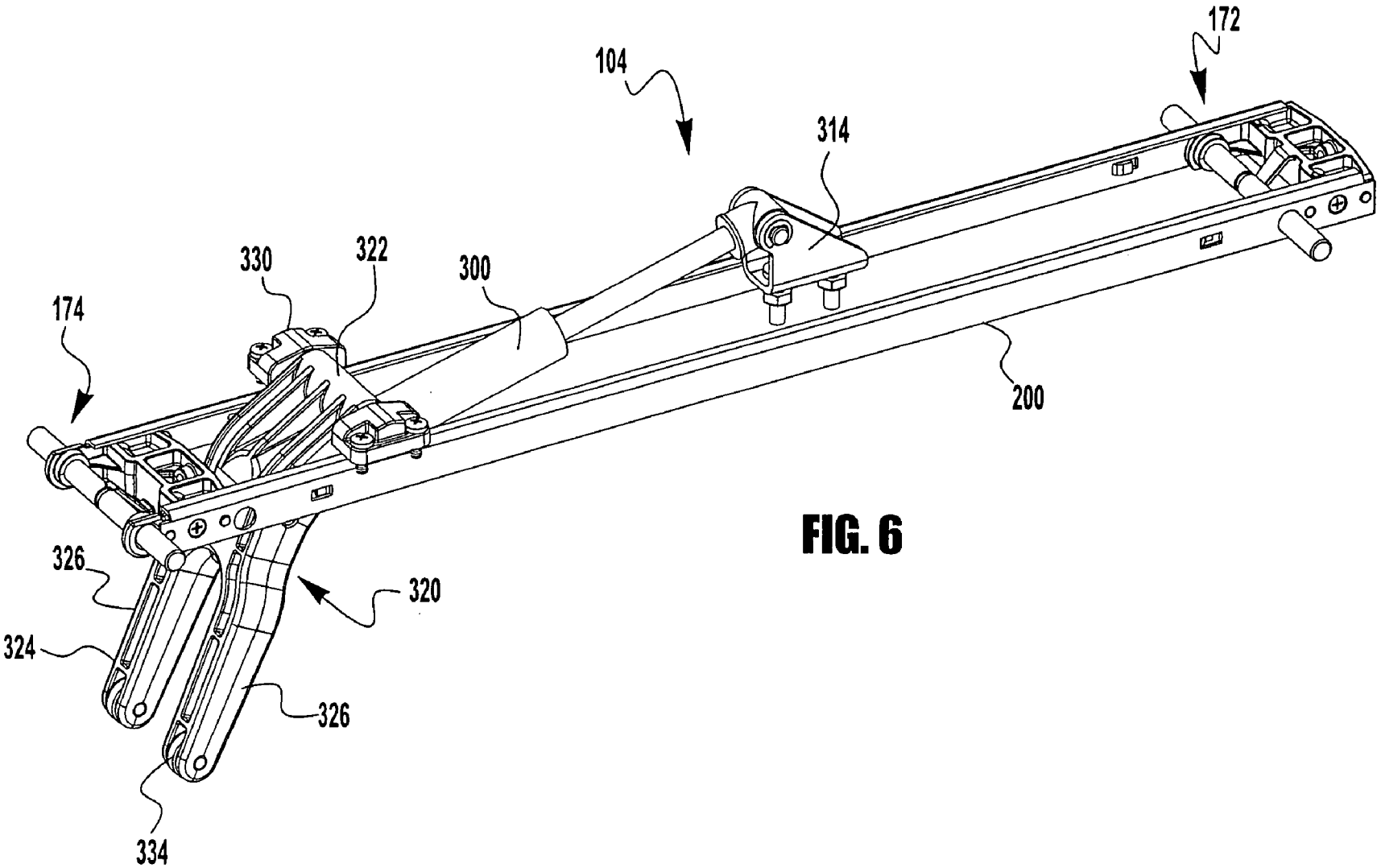
FIG. 6 is a top perspective view of a portion of a pivot mechanism of a trolling motor mount system according to an exemplary embodiment.

Referring to FIGS. 6 and 7, lower arm 150 is configured to support the other components of the pivot mechanism and to coupled pivot mechanism 104 to housing 102. According to a preferred embodiment, lower arm 150 is an elongated member extending from a first end 152 to an opposite second end 154. Lower arm 150 includes a top surface 156 and a bottom surface 158. Preferably, top surface 156 and bottom surface 158 are separated by a pair of spaced apart sidewalls 160 extending longitudinally from first end 152 to second end 154. According to a particularly preferred embodiment, top surface 156 (shown in FIG. 3), bottom surface 158, and sidewalls 160 define an aperture shown as opening 162 extending at least partially through lower arm 150.

Latch system 170 is configured to releasably retain mount system 100 in both the deployed and stowed positions. According to an exemplary embodiment, an operator must actuate latch system 170 before moving trolling motor 50 from the deployed position to the stowed position. Preferably, an operator must also actuate latch system 170 before moving trolling motor 50 from the stowed positioned to the deployed position. Latch system 170 is intended to prevent and protect against unintended movement of mounting system 100 which may harm trolling motor 50 or an operator. According to an exemplary embodiment, latch system 170 includes a front latch 172 and a rear latch 174.

Referring to FIG. 3, front latch 172 includes a slider (shown as a pin holder 180), a pin 182 coupled to pin holder 180, and a pair of elongated slots 184 disposed in sidewalls 160 of lower arm 150 near second end 156. Pin holder 180 is received in opening 162 of lower arm 120 and configured to move in a slidable manner along a longitudinal axis. Pin 182 extends through slots 184 in lower arm 150 and engages catch 124 formed in bow plate 110 when trolling motor 50 is in the deployed position. Front latch 172 is intended to retain mounting system 100 in the deployed position until front latch 172 is actuated by an operator.

According to an exemplary embodiment, a flexible link (e.g., rope, chain, wire, band, strap, etc.) shown as a cord 186 in FIG. 1 is coupled to pin holder 180 to allow an operator to actuate front latch 172. As mentioned above, bow guard 140 includes aperture 149 configured to receive cord 186 in a slidable manner. According to a preferred embodiment, a first end of cord 186 is coupled to pin holder 180 and a second end passes through aperture 149 and is accessible to an operator. Cord 186 may include a handle portion 188 coupled to its second end one end to allow an operator to more easily grip and pull cord 186. To actuate front latch 172, an operator pulls on cord 186 to slidably move pin holder 180 in a forward direction. Pin 182 moves with pin holder 180 and disengages catch 124 as pin 182 moves in a forward direction. The range of movement of pin holder 180 in a longitudinal direction may be defined by the size of slots 184.

Referring to FIG. 3, rear latch 174 includes a slider (shown as a pin holder 190), a pin 192 coupled to pin holder 190, and a pair of elongated slots 194 disposed in sidewalls 160 of lower arm 150 near first end 154. Pin holder 190 is received in opening 162 of lower arm 120 and configured to move in a slidable manner along a longitudinal axis. Pin 192 extends through slots 194 in lower arm 150 and engages catch 126 positioned near first end 114 of bow plate 110 when trolling motor 50 is in the stowed position. Rear latch 174 is intended to releasably retain mount system 100 in the stowed position until an operator actuates rear latch 174.

Front latch 172 is coupled to rear latch 174 by a connector member 200 so that when an operator actuates front latch 172, connector 174 transfers the movement to actuate rear latch 174. According to a preferred embodiment, connector member 200 is a relatively thin piece of material that slidably moves along sidewall 160 of lower arm 150. According to an exemplary embodiment, an operator actuates rear latch 174 by pulling on cord 186 to disengage pin 194 from catch 126. Applying a force to cord 186 causes pin holder 180 to slide forward, which thereby causes connector member 200 to slide forward, which thereby causes pin holder 190 to slide forward. As pin holder 190 moves in a forward direction, pin 194 disengages catch 126. According to alternative embodiments, additional latches may be provided so that the trolling motor may be locked in a plurality of other stowed and/or deployed positions.

Referring to FIGS. 4 and 5, motion control or dampening device or mechanism 300 is configured to provide an impedance or resistance to movement of trolling motor 50 to control the velocity of movement of trolling motor 50. When trolling motor 50 is being moved (e.g., towards the stowed portion and/or towards the deployed position), motion dampening device 300 provides a resisting or impeding force. According to a preferred embodiment, motion dampening device 300 also provides a biasing force (e.g., a return force) that biases trolling motor 50 in the stowed position (e.g., to assist in the movement of trolling motor 50 towards the stowed position and to counteract a torque force due to the weight of trolling motor 50). An applied force from motion dampening device 300 increases to approach the force of the input load (which is provided by the user lifting or lowering trolling motor 50). The applied force approaches a zero-net force, resulting in zero acceleration and a constant velocity which is preferably limited to a desired value. (As such, the applied force is configured to counter-balance the torque created by movement of trolling motor 50.)

According to an exemplary embodiment, and referring to FIGS. 3 and 6, motion dampening device 300 includes a first end 302 that is coupled to yoke 320 by a pivot shaft or rod 310 and a second end 304 that is coupled to lower arm 150 by a pivot shaft or rod 312 and a bracket 314.

According to a preferred embodiment, motion dampening device 300 is a gas or pneumatic spring that provides a constant impedance or resistance to movement of trolling motor 50 and is biased to its extended position. According to an exemplary embodiment, motion dampening device 300 provides a varying impedance or resistance to movement of trolling motor 50. According to an exemplary embodiment, the damper is of a type commercially available as "Series 16-4 gas spring" (Model No. 16-4-125-085-A290-B290-578 or Model No. 16-4-125-085-A290-B290-645) from Suspa Incorporated. According to alternative embodiments, the motion dampening device may be any of a variety of air, gas, liquid, elastomer, spring, or hydraulic devices, shocks, or shock absorber, dashpot mechanisms, air spring, cylinders, actuators that dampen or resist motion or combinations thereof. According to further alternative embodiments, the damper provides a variable impedance or resistance (e.g., an increasing or decreasing amount of impedance, a partial dampening stroke, and the like).

According to an exemplary embodiment, a protective cover such as boot (not shown) may be placed around a portion of motion dampening device 300 to protect against contamination from contaminants such as water, dirt, dust, and the like.

Motion dampening device 300 acts on the pivot lever shown as yoke 320 to impede to movement of trolling motor 50 between the stowed and deployed positions and to bias the movement of trolling motor 50 towards the stowed position when trolling motor 50 is being moved between the deployed and stowed positions. Referring to FIGS. 5 and 6, yoke 320 includes a first end 322 that is rotatably coupled to lower arm 150 (shown in FIG. 5) and a second end 324 having a pair of spaced apart arms 326 (e.g., forked) that engage bow plate 110 during at least a portion of the range of the pivoting of trolling motor 50. Yoke 320 further includes a recess 328 for receiving first end 302 and the corresponding pivot or shaft rod 310 of motion dampening device 300.

According to an exemplary embodiment, a pair of mounting brackets 330 are mounted to lower arm 150 for retaining first end 322 of yoke 320. According to a preferred embodiment, a pivot or shaft rod 332 extends through first end 322 and engages a recess formed in mounting brackets 330. Shaft rod 332 and mounting brackets 330 cooperate to retain yoke 320 to lower arm 150 while allowing for the pivotal movement of yoke 320 about first end 322. According to a preferred embodiment, yoke 320 includes rollers 334 at the bottom portion of each arm 326. Rollers 334 are intended to reduce friction between yoke 320 and bow plate 110 to provide for the smooth and consistent movement of mount system 100. According to an alternative embodiment, the yoke includes a single arm that bears against the base (or a single roller that rolls along bow plate). Dampening of movement of the trolling motor may be configured to occur during only a portion of its range of pivotal movement. For example, extending of motion dampening device 300 and pivoting of yoke 320 and rolling contact of rollers 334 may be configured to occur between the deployed position and a generally vertical position. According to a preferred embodiment, the dampening force provided by motion dampening device 300 may be provided between the deployed position and about 60 degrees. According to a particularly preferred embodiment, the dampening force provided by motion dampening device 300 may be provided between the deployed position and about 45 or 50 degrees. According to an alternative embodiment, the dampening force provided by the motion dampening device may be provided between any of a variety of range of the pivotal movement of the trolling motor.

According to a preferred embodiment, yoke 320 is configured to receive motion dampening device 300 between spaced apart arms 326 when trolling motor 50 is in the deployed position. According to a particularly preferred embodiment, yoke 320 is configured to receive and retain shaft 54 of trolling motor 50 between spaced apart arms 326 when trolling motor 50 is in the stowed position (shown in FIG. 2). Configuring yoke 320 to receive shaft 54 is intended to hinder the movement of trolling motor 50 when in the stowed position and thereby protect trolling motor 50 when not in use (e.g., in rough waters a stowed trolling motor, if not retained, may tend to get bounced around which may cause damage to the trolling motor).

Movement or actuation of trolling motor 50 from the stowed position to the deployed position is initiated by an operator lifting trolling motor 50 from its stowed position and moving it towards its deployed position by pulling on cord 186. The tension in cord 186 unlatches rear latch 174 and allows trolling motor to pivot about pivot pin 111 (e.g., by continuous pulling of cord 186 by the operator). As trolling motor 50 begins to move, lower arm 150 moves yoke 320 into contact with bow plate 110 which actuates motion dampening device 300. As mentioned above, in the stowed positioned motion dampening device 300 is in an extended position and moves towards a retracted position as trolling motor 50 is moved to the deployed position. Motion dampening device 300 impedes the movement or velocity of trolling motor 50 as it is being moved between its stowed and deployed positions. Controlling or dampening the movement or velocity of trolling motor 50 is intended to avoid impact noise and potential damage to components.

Movement or actuation of trolling motor 50 from the deployed position to the stowed position is initiated by an operator lifting trolling motor 50 from its deployed position and moving it towards its stowed position by pulling on cord 186. The tension in cord 186 unlatches front latch 172 and allows trolling motor to pivot about pivot pin 111 (e.g., by continuous pulling of cord 186 by the operator). Once front latch 172 is disengaged, motion dampening device 330 will exert a force on yoke 320 which is transfer to bow plate 110 since motion dampening device is biased towards an extended position. The force exerted by motion dampening device 300 will at least support a portion of trolling motor 50, otherwise supported by the operator, and may assist in pivotally moving trolling motor 50 from the deployed position to the stowed position. Biasing and assisting in the movement of trolling motor 50 is intended to reduce the amount of force that must be exerted by an operator to move trolling motor 50 between the deployed and stowed positions.

It is also important to note that the construction and arrangement of the elements of the mount system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces (e.g. latches, pins, apertures, etc.) may be reversed or otherwise varied, or the length or width of the structures and/or members or connectors or other elements of the system may be varied. It should be noted that the elements and/or assemblies of the system may be constructed from any of a wide variety of materials that provide sufficient strength or durability, in any of a wide variety of colors, textures and combinations. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The invention claimed is:

1. An apparatus for mounting a trolling motor to a watercraft, the apparatus comprising:

a base;

a motor support for carrying a trolling motor;

an upper arm and a lower arm connected between the base and the motor support for pivotal movement of the motor support between a stowed position and a deployed position;

a lever having a pivot end pivotally connected to the lower arm and having a free end that slidably engages the base as the arms and the motor support move toward and away from the deployed position; and a motion control device connected between the lower arm and the lever to provide a bias force to the lever to resist movement of the arms and motor support toward and assist movement away from the deployed position, wherein a first end of the motion control device is coupled to the lower arm and a second end of the motion control device is coupled to the lever between the pivot end and the free end of the lever.

2. The apparatus of claim 1, wherein the lever includes a pair of spaced apart arms at its free end.

3. The apparatus of claim 1, wherein each of the spaced apart arms includes a roller for engagement with the base during at least a portion of the movement between the deployed position and the stowed position.

4. The apparatus of claim 1, further comprising a first latch carried by the lower arm to engage the base when in the deployed position.

5. The apparatus of claim 4, wherein the first latch includes a pin movable to engage a slot in the base.

6. The apparatus of claim 4, further comprising a flexible member having a first end coupled to the first latch and a second end having a gripping portion.

7. The apparatus of claim 1, wherein the motion control device comprises at least one of a gas spring, a shock, a damper, a hydraulic shock, or a solid spring.

8. The apparatus of claim 1, wherein the motion control device is configured to provide a generally constant impedance.

9. A trolling motor for use with a watercraft, the trolling motor comprising:

a head portion;

a propulsion unit;

a shaft coupling the propulsion unit to the head portion; and a mounting system configured to secure the trolling motor to the watercraft and to pivot the trolling motor between a deployed position and a stowed position, the mounting system comprising:

a base adapted to be mounted to the watercraft;

a motor support coupled to the shaft;

a pivotable linkage connected to the base and the motor support for pivoting between the deployed position and the stowed position; and a damper mechanism coupled to the pivotable linkage and configured to impede the movement of the linkage toward the deployed position and to assist movement of the linkage away from the deployed position, the damper mechanism including a lever pivotally connected to the linkage for slidably engaging the base and a device for providing a bias force to the lever, wherein the lever includes a first end pivotally coupled to the linkage and a second end for slidably engaging the base, and wherein a first end of the device for providing a bias force is coupled to the linkage and a second end of the device is coupled to the lever between the first end of the lever and the second end of the lever.

10. The trolling motor of claim 9, wherein the lever includes a pair of spaced apart arms having lower portions for engaging the base.

11. The trolling motor of claim 10, wherein the shaft of the trolling motor is received between the spaced apart arms when the trolling motor is in the stowed position, and wherein the device for providing a bias force is received between the spaced apart arms when the trolling motor is in the deployed position.

12. The trolling motor of claim 9, wherein the lever provides the bias force to the base during only a portion of the pivotal movement of the linkage.

13. The trolling motor of claim 12, wherein the lever provides the bias force to the base between the deployed position and about fifty degrees pivotal movement from the deployed position.

14. The trolling motor of claim 9, wherein the device for providing a bias force comprises a gas spring.

15. A trolling motor for use with a watercraft, the trolling motor comprising:

a head portion;

a propulsion unit;

a shaft coupling the propulsion unit to the head portion;

a base for attachment to a watercraft;

a motor mount coupled to the shaft;

a linkage connected between the base and the motor mount and configured to pivot between a deployed position and a stowed position; and means for slidably engaging the base to deliver a bias force that impedes movement of the linkage as it approaches the deployed position and that assists movement of the linkage as it moves away from the deployed position;

wherein the means for slidably engaging includes a lever having a first end pivotally coupled to the linkage and a second end for engaging the base; and a device for providing the bias force coupled at one end to the linkage and at an opposite end to the lever between the first end of the lever and the second end of the lever.

16. The trolling motor of claim 15, wherein the lever includes a pair of spaced apart arms having lower portions for contacting the base portion.

17. An apparatus for mounting a trolling motor to a watercraft, the apparatus comprising:

a base;

a motor support for carrying a trolling motor;

an upper arm and a lower arm connected between the base and the motor support for pivotal movement of the motor support between a stowed position and a deployed position;

a lever pivotally connected to the lower arm and having a free end that slidably engages the base as the arms and the motor support move toward and away from the deployed position; and a motion control device connected between the lower arm and the lever to provide a bias force to the lever to resist movement of the arms and motor support toward and assist movement away from the deployed position;

a first latch carried by the lower arm to engage the base when in the deployed position; and a second latch carried by the lower arm to engage the base when in the stowed position.

18. The apparatus of claim 17, wherein the first latch is coupled to the second latch by a connector so that actuation of the first latch causes actuation of the second latch.

19. The apparatus of claim 17, wherein the first latch includes a pin movable to engage a slot in the base.

20. The apparatus of claim 17, further comprising a flexible member having a first end coupled to the first latch and a second end having a gripping portion.

21. A trolling motor for use with a watercraft, the trolling motor comprising:

a head portion;

a propulsion unit;

a shaft coupling the propulsion unit to the head portion; and a mounting system configured to secure the trolling motor to the watercraft and to pivot the trolling motor between a deployed position and a stowed position, the mounting system comprising:

a base adapted to be mounted to the watercraft;

a motor support coupled to the shaft;

a pivotable linkage connected to the base and the motor support for pivoting between the deployed position and the stowed position; and a damper mechanism coupled to the pivotable linkage and configured to impede the movement of the linkage toward the deployed position and to assist movement of the linkage away from the deployed position, the damper mechanism including a lever pivotally connected to the linkage for slidably engaging the base and a device for providing a bias force to the lever, wherein the lever includes a pair of spaced apart arms having lower portions for engaging the base portion, and wherein the shaft of the trolling motor is received between the spaced apart arms when the trolling motor is in the stowed position.

22. The trolling motor of claim 21, wherein the lever includes a first end pivotally coupled to the linkage and a second end for slidably engaging the base.

23. The trolling motor of claim 22, wherein a first end of the device for providing a bias force is coupled to the linkage and a second end of the device is coupled to the lever.

24. A trolling motor for use with a watercraft, the trolling motor comprising:

a head portion;

a propulsion unit;

a shaft coupling the propulsion unit to the head portion; and a mounting system configured to secure the trolling motor to the watercraft and to pivot the trolling motor between a deployed position and a stowed position, the mounting system comprising:

a base adapted to be mounted to the watercraft;

a motor support coupled to the shaft;

a pivotable linkage connected to the base and the motor support for pivoting between the deployed position and the stowed position;

a damper mechanism coupled to the pivotable linkage and configured to impede the movement of the linkage toward the deployed position and to assist movement of the linkage away from the deployed position;

a first latch configured to engage the base when in the first position; and a second latch configured to engage the base when in the second position, wherein the first latch is coupled to the second latch by a connector so that actuation of the first latch causes actuation of the second latch.

25. The trolling motor of claim 24, wherein the first latch includes a pin movable to engage a slot in the base when the pivot member is in the first position.

26. The trolling motor of claim 25, further comprising a flexible member having a first end coupled to the first latch and a second end having a grippable portion.

27. A trolling motor for use with a watercraft, the trolling motor comprising:

a head portion;

a propulsion unit;

a shaft coupling the propulsion unit to the head portion;

a base for attachment to a watercraft;

a motor mount coupled to the shaft;

a linkage connected between the base and the motor mount and configured to pivot between a deployed position and a stowed position;

means for slidably engaging the base to deliver a bias force that impedes movement of the linkage as it approaches the deployed position and that assists movement of the linkage as it moves away from the deployed position; wherein the means for slidably engaging includes a lever having a first end pivotally coupled to the linkage and a second end for engaging the base, wherein the lever includes a pair of spaced apart arms having lower portions for contacting the base portion, and wherein the shaft of the trolling motor is received between the spaced apart arms when the trolling motor is in the stowed position; and a device for providing the bias force coupled at one end to the linkage and at an opposite end to the lever.

28. The trolling motor of claim 27, wherein the device for providing the bias force is received between the spaced apart arms when the trolling motor is in the deployed position.

29. A trolling motor for use with a watercraft, the trolling motor comprising:

a head portion;

a propulsion unit;

a shaft coupling the propulsion unit to the head portion;

a base for attachment to a watercraft;

a motor mount coupled to the shaft;

a linkage connected between the base and the motor mount and configured to pivot between a deployed position and a stowed position;

means for slidably engaging the base to deliver a bias force that impedes movement of the linkage as it approaches the deployed position and that assists movement of the linkage as it moves away from the deployed position; wherein the means for slidably engaging includes a lever having a first end pivotally coupled to the linkage and a second end for engaging the base;

a device for providing the bias force coupled at one end to the linkage and at an opposite end to the lever;

a first latch carried by the linkage for engaging the base when in the deployed position; and a second latch carried by the linkage for engaging the base when in the stowed position, wherein the first latch is coupled to the second latch by a connector so that actuation of the first latch causes actuation of the second latch.

* * * * *